US009527338B1

(12) United States Patent
Kalb

(10) Patent No.: US 9,527,338 B1
(45) Date of Patent: Dec. 27, 2016

(54) PAINT CAN RIM COVER

(71) Applicant: John Robert Kalb, St. Augustine, FL (US)

(72) Inventor: John Robert Kalb, St. Augustine, FL (US)

( * ) Notice: Subject to any disclaimer, the term of this patent is extended or adjusted under 35 U.S.C. 154(b) by 0 days.

(21) Appl. No.: 15/181,385

(22) Filed: Jun. 13, 2016

(51) Int. Cl.
*B65D 25/20* (2006.01)
*B44D 3/12* (2006.01)
*B65D 90/00* (2006.01)

(52) U.S. Cl.
CPC ..... *B44D 3/128* (2013.01); *B65D 25/20* (2013.01)

(58) Field of Classification Search
CPC ..... B44D 3/128; B44D 3/127; B65D 25/20
USPC ..... 220/698, 699, 701, 695, 287
See application file for complete search history.

(56) References Cited

U.S. PATENT DOCUMENTS 2,660,333 A * 11/1953 Paxton ..... B44D 3/128 220/701
2,873,881 A * 2/1959 Nichols ..... B65D 25/48 220/4.03
3,221,955 A * 12/1965 Banaszak ..... B65D 25/48 220/701
3,655,089 A * 4/1972 Tower ..... B65D 43/0218 215/228
3,894,650 A * 7/1975 Crump ..... B65D 25/20 220/695
3,945,527 A * 3/1976 Pylant ..... B44D 3/128 220/695
4,125,210 A * 11/1978 Embree ..... B65D 47/12 220/254.7
4,150,763 A * 4/1979 Simpson ..... B44D 3/162 220/287
5,062,552 A * 11/1991 Heubel ..... B65D 25/48 220/287
5,779,093 A * 7/1998 Poole ..... B44D 3/128 220/698
5,893,489 A * 4/1999 Giarrante ..... B44D 3/127 220/254.8
5,975,346 A * 11/1999 Imperato ..... B44D 3/123 220/284
2007/0221675 A1* 9/2007 Bootz ..... B44D 3/12 220/699

* cited by examiner

*Primary Examiner* — J. Gregory Pickett
*Assistant Examiner* — Niki M Eloshway
(74) *Attorney, Agent, or Firm* — Mark Young, PA

(57) ABSTRACT

A paint can rim cover attaches to a grooved annular rim of a paint can. The rim cover is an annular cover with concentric inner and outer cylindrical walls and an intermediate cylindrical plug extending from the bottom surface of the annular cover. An inner fin extends outwardly from the bottom of the inner cylindrical wall and an outer fin extends inwardly from the bottom of the outer cylindrical wall. When attached, the plug substantially fills the groove and the fins engage inner and outer edges of the rim.

9 Claims, 12 Drawing Sheets

PAINT CAN RIM COVER

FIELD OF THE INVENTION

This invention relates generally to rimmed paint cans and, more particularly, to a protective cover for the rim of a paint can.

BACKGROUND

Paint cans, which are designed to be liquid tight, employ lever lid closures. A radially inwardly extending ring element is secured to the top of the sidewall of the can. The major (outer) diameter of the ring embodies a seaming panel for mechanical folded or rolled seaming to a can flange. A ring groove extends in a circular path entirely around the ring element between the major and minor (inner) diameters of the ring. The inner periphery of the ring defines a rolled edge. The area at the top of the can that is not covered by the ring element defines a circular can opening.

A lid is friction fit onto the rim, covering the opening. The lid includes a central downward projection that fits tightly in the circular can opening. The lid also includes a concentric annular groove sized, shaped and positioned to snugly receive a portion of the rolled inner periphery of the ring. The lid also includes a concentric annular protrusion sized, shaped and positioned to snugly fit within the ring groove. The outside diameter of the lid extends substantially over the ring to provide an outer edge for prying engagement with a lever-opening tool.

To use the contents of the paint can, e.g., paint, shellack, varnish, stain, etc. . . . , a user pries the lid off the ring. Then the user may dip a brush into the can or pour contents from the can. Contents of the can inevitably drip into the ring groove. If the contents are liquid when the lid is re-installed, the contents eventually dry and bond the lid to the ring, making the ring difficult or impossible to remove. When the contents dry in the groove, the lid no longer provides a tight leak-proof seal. Air intrudes into the can through the compromised seal and prematurely dries the contents. Concomitantly, the contents are susceptible to leaking from the can through the compromised seal, particularly during transportation. Thus, fouling of the rim with contents of the can leads to inconvenience (e.g., difficulty in removing a lid), waste (e.g., prematurely dried-out contents) and mess (e.g., spillage).

What is needed is a cost-effective device that guards and prevents fouling of the rim when the lid is removed. The device should install easily, yet securely engage the rim. The device should be scalable to protect various sizes of rimmed paint cans. Preferably, the device also includes features that facilitate pouring of contents and wiping of excess paint from a brush.

The invention is directed to overcoming one or more of the problems and solving one or more of the needs as set forth above.

SUMMARY OF THE INVENTION

To solve one or more of the problems set forth above, in an exemplary implementation of the invention, a paint can rim cover attaches to a paint can having an annular rim with an inner edge defining a central opening having a rim inner diameter. The rim has an outer edge defining a rim outer periphery having a rim outer diameter. The rim also has a groove, between the inner edge and the outer edge, having a groove diameter, groove width and groove depth.

The exemplary rim cover includes an annular cover with a top surface, a bottom surface opposite the top surface, an outer periphery, an inner periphery, a major diameter at the outer periphery, a minor diameter at the inner periphery, and an annular cover thickness measured from the top surface of the annular cover to the bottom surface of the annular cover.

The exemplary rim cover also includes an outer wall forming an outer cylinder having an outer diameter extending from the bottom surface of the annular cover and having a free end, an outer side, an inner side, an outer wall length defined by a distance from the bottom surface of the annular cover to the free end of the outer wall.

The exemplary rim cover also includes an inner wall forming an inner cylinder having an inner diameter extending from the bottom surface of the annular cover and having a free end an outer side, an inner side, an inner wall length defined by a distance from the bottom surface of the annular cover to the free end of the inner wall.

The rim cover includes a pair of opposed fins for engaging the bottom of the inner and outer edges of the can rim. An outer fin extends radially from the inner side of the outer wall adjacent to the free end of the outer wall. An inner fin extends radially from the outer side of the inner wall adjacent to the free end of the inner wall, opposite to and towards the outer fin. The inner fin and outer fin may each have a generally triangular cross-section shape. The inner fin extends from the outer side of the inner wall up to one half of the width of the inner cavity, preferably less, more preferably enough to engage the bottom of the inner edge of the can rim. The outer fin extending from the inner side of the outer wall less than one half of the width of the outer cavity, preferably less, more preferably enough to engage the bottom of the outer edge of the can rim.

A plug forming an intermediate cylinder having an intermediate diameter extending from the bottom surface of the annular cover and having a free end, an outer side and an inner side, a plug length defined by a distance from the bottom surface of the annular cover to the free end of the plug, a plug width defined by a distance from the outer side to the inner side. The plug is between the inner cylinder and the outer cylinder. The free end of the plug at the inner and outer sides may be filleted, i.e., rounded, to more closely conform to the shape of the groove of the rim.

An inner cavity (e.g., annular channel) is formed between the inner wall and the plug. The inner cavity has an inner cavity width measured from the outer side of the inner wall to the plug. An outer cavity (e.g., annular channel) is formed between the outer wall and the plug. The outer cavity has an outer cavity width measured from the inner side of the outer wall to the plug.

The inner diameter is less than the rim inner diameter, less than the major diameter, less than the outer diameter, less than the intermediate diameter, and at least as great as the minor diameter. The outer diameter is greater than the rim outer diameter, greater than the minor diameter, greater than the inner diameter, greater than the intermediate diameter, and not greater than the major diameter. The intermediate diameter is between the inner diameter and the outer diameter, and about equal to the groove diameter. The annular ring, inner cylinder, intermediate cylinder, and outer cylinder are concentric. The plug length, inner wall length and outer wall length are about equal (+/−15%), and the plug length is about equal to the groove depth and the plug width is about equal to the groove width. As used herein about denotes a range of +/−15%.

Optionally, an inner wiping ledge extends from the inner periphery of the annular cover at the top surface of the annular cover. The inner wiping ledge is a reduced thickness inner cantilever projection having an inner ledge thickness that is less than the annular cover thickness. Optionally, an outer ledge extends from the outer periphery of the annular cover at the top surface of the annular cover. The outer ledge is a reduced thickness outer cantilever projection having an outer ledge thickness that is less than the annular cover thickness.

A rim cover assembly according to principles of the invention may include an outer rim cover for a first size paint can, and an inner rim cover for a second size paint can smaller than the first size paint can. The outer rim cover and the inner rim cover are concentric and in the same plane (i.e., have top surfaces that are in the same plane). The outer rim cover is coupled to the inner rim cover by a plurality of severable couplings (i.e., couplings that can be broken or cut).

A rim cover assembly according to principles of the invention may include an outer rim cover for a first size paint can, an intermediate rim cover for a second size paint can smaller than the first size paint can, and an inner rim cover for a third size paint can smaller than the second size paint can. The outer rim cover and the intermediate rim cover and the inner rim cover are concentric and in the same plane (i.e., have top surfaces that are in the same plane). The outer rim cover is coupled to the intermediate rim cover by a plurality of severable couplings (i.e., couplings that can be broken or cut). The intermediate rim cover is coupled to the inner rim cover by a plurality of severable couplings. The can sizes may be gallon, quart and pint.

BRIEF DESCRIPTION OF THE DRAWINGS

The foregoing and other aspects, objects, features and advantages of the invention will become better understood with reference to the following description, appended claims, and accompanying drawings, where:

Figure 1:
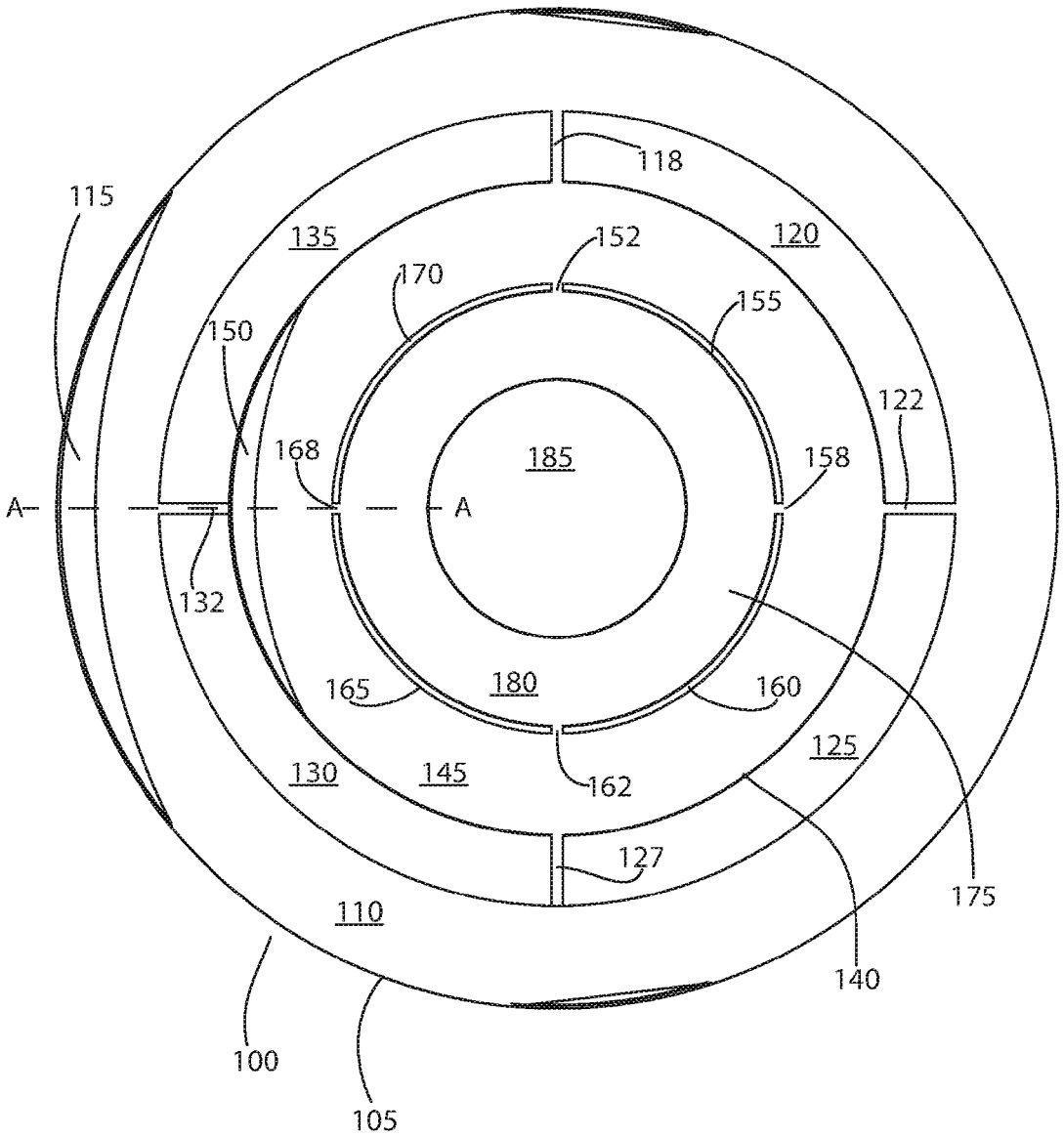
FIG. 1 is a plan view of an exemplary paint can rim cover assembly comprising three separable paint can rim covers according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A plastic paint can rim cover according to principles of the invention provides a plug that substantially fills a rim groove of a paint can, inner and outer fins that engage the bottom of the inner and outer edges, respectively, of the rim of a paint can, and cavities for receiving the inner and outer edges of the paint can. The plug prevents fouling of the rim groove with contents of the paint can. The paint can rim cover according to principles of the invention may be scaled for any compatible paint can size, including pint, quart and gallon paint cans.

A rim cover according to principles of the invention is used with a paint can having an annular rim with an inner edge defining a central opening having a rim inner diameter, an outer edge defining a rim outer periphery having a rim outer diameter, and a rim groove between the inner edge and the outer edge having a groove diameter, groove width and groove depth. The inner edge is typically a rolled or folded edge. The outer edge is typically a rolled or folded edge.

A plurality of paint can rim covers according to principles of the invention may be integrally formed as an assembly, with larger and smaller covers being concentric and each rim cover being separable by breaking or cutting frangible or severable couplings (couplings that may be torn, snapped apart or cut). By way of example and not limitation, an assembly may include three concentric rim covers (e.g., a gallon, quart and pint rim cover), or two concentric rim covers (e.g., a gallon and a quart rim cover, or a gallon and a pint rim cover, or a quart and a pint rim cover).

Referring now to FIGS. 1 through 4, plan, side and top perspective views of an exemplary paint can rim cover assembly 100 comprising three separable annular (ring-shaped) paint can rim covers 105, 140, 175 according to principles of the invention are conceptually illustrated. Spaces 120, 125, 130, 135 and severable couplings 118, 122, 127, 132 separate an outer rim cover 105 from an intermediate rim cover 140. The severable couplings 118, 122, 127, 132 are thin cuttable or breakable (frangible) connections that may be cut or broken to separate the outer rim cover 105 from the intermediate rim cover 140. Any remaining portion of the cut or broken couplings 118, 122, 127, 132 may be ignored or trimmed off with clippers, scissors, pliers or a user fingers.

Each annular rim cover 105, 140 has a top surface 110, 145, an opposite bottom surface on the underside, an outer periphery, an inner periphery, a major diameter at the outer periphery, a minor diameter at the inner periphery, and an annular cover thickness measured from the top surface of the annular cover to the bottom surface of the annular cover. The minor diameter of the inner periphery of a larger rim cover exceeds the major diameter of the outer periphery of each smaller rim cover in the assembly 100, allowing each rim cover to be arranged concentrically in planar alignment.

Spaces 155, 160, 165, 170 and severable couplings 152, 158, 162, 168 separate an inner rim cover 175 from the intermediate rim cover 140. The severable couplings 152, 158, 162, 168 are thin cuttable or breakable (frangible) connections that may be cut or broken to separate the inner rim cover 175 from the intermediate rim cover 140. Any remaining portion of the cut or broken couplings 152, 158, 162, 168 may be ignored or trimmed off with clippers, scissors, pliers or a user fingers. Each rim cover 140, 175 has a top surface 145, 180 and an opposite bottom surface on the underside. The inner edge of each rim cover defines a circular opening, such as opening 185 for the inner rim cover.

Figure 2:
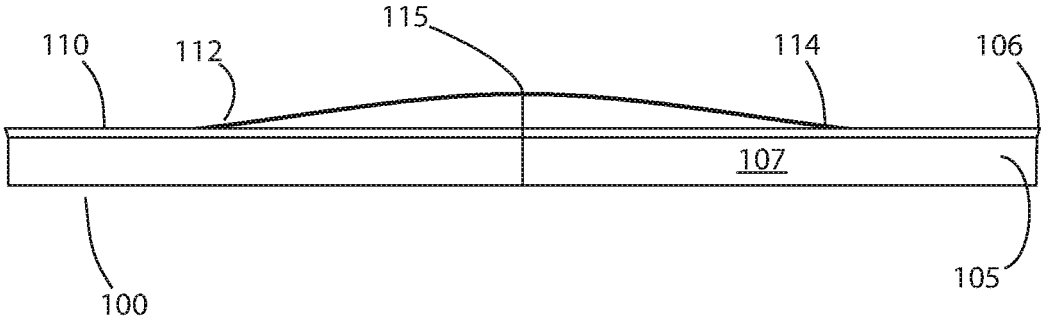
FIG. 2 is a first side view of an exemplary paint can rim cover assembly comprising three separable paint can rim covers according to principles of the invention.
Figure 3:
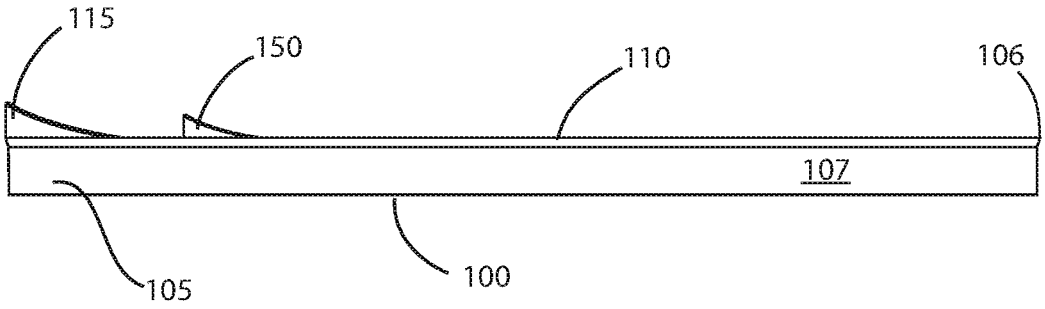
FIG. 3 is a second side view of an exemplary paint can rim cover assembly comprising three separable paint can rim covers according to principles of the invention.

As more clearly illustrated in FIGS. 2 and 3, one or more of the rim covers may include a pouring spout 115, 150 projecting upwardly from the top surface 110, 145 of the rim cover 105, 140. While spouts 115, 150 are illustrated on only the outer and intermediate rim covers 105, 140 in FIGS. 2 and 3, the invention is not limited to such a configuration of spouts. Each rim cover according to principles of the invention may have or omit a spout.

Each spout 115, 150 extends upwardly from the outer edge of the rim cover 105, 140. The spout 115, 150 extends over an arc comprising about ⅕ to ⅓ of the outer perimeter of the rim cover, preferably about ¼ of the outer perimeter of the rim cover. Each spout is symmetric about its peak 115 and gradually slope downwardly from the peak 115 to outermost edges 112, 114 that intersect the top surfaces 110, 145.

Figure 4:
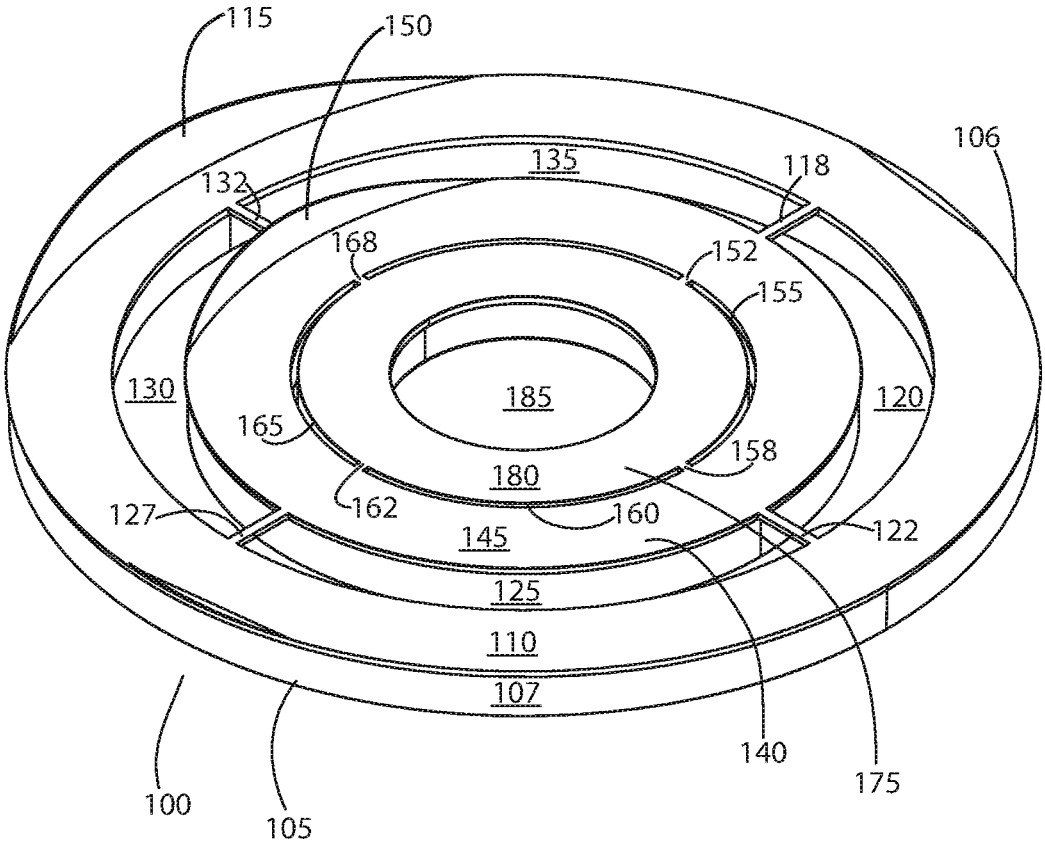
FIG. 4 is a top perspective view of an exemplary paint can rim cover assembly comprising three separable paint can rim covers according to principles of the invention.
Figure 6:
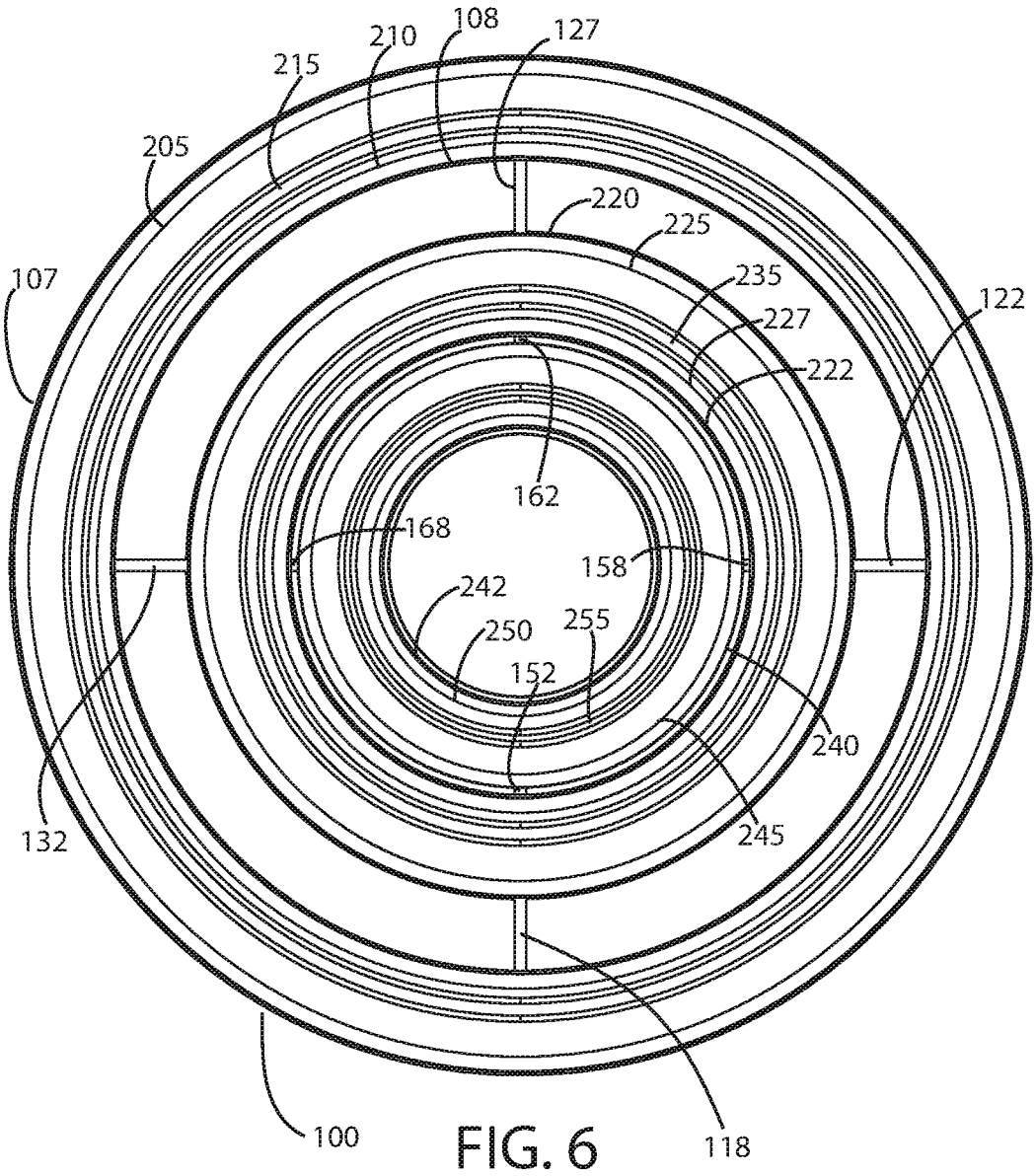
FIG. 6 is a bottom view of an exemplary paint can rim cover assembly comprising three separable paint can rim covers according to principles of the invention.
Figure 7:
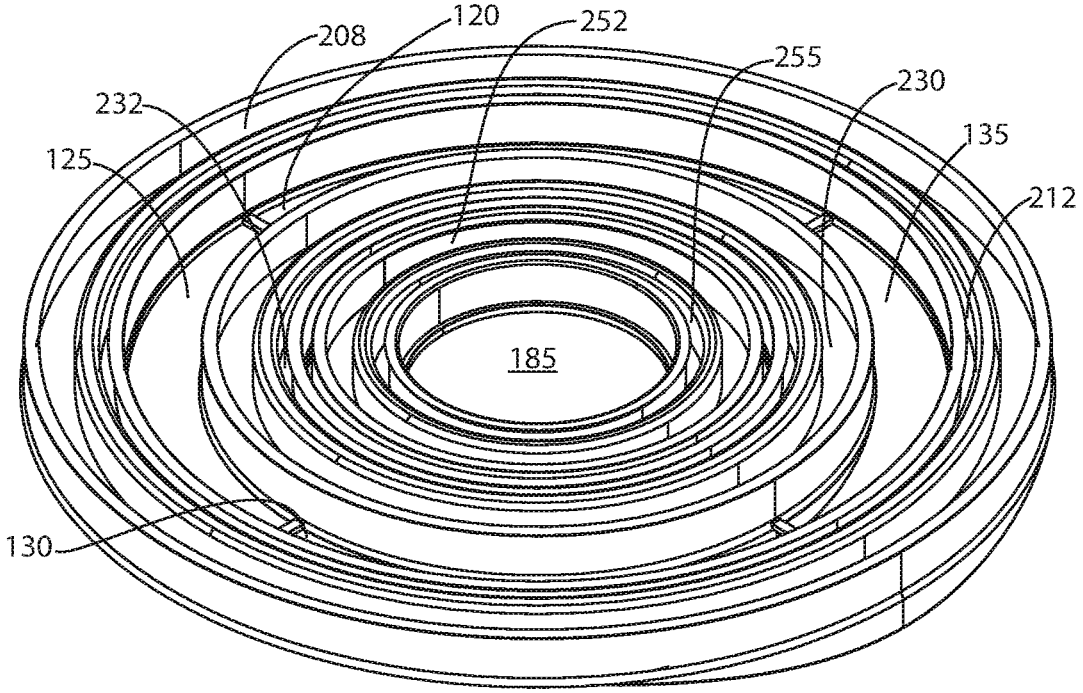
FIG. 7 is a bottom perspective view of an exemplary paint can rim cover assembly comprising three separable paint can rim covers according to principles of the invention.

With reference to the side views of FIGS. 2, 3, bottom view of FIG. 6, and perspective views of FIGS. 4 and 7, outer and inner sidewalls and plugs, and spaces between these features are illustrated for each rim cover 105, 140, 175 of the assembly 100. Each rim cover 105, 140, 175 includes an outer wall 107, 125, 240 forming an outer cylinder for the corresponding rim cover 105, 140, 175 having an outer diameter and extending from the bottom surface of the annular cover 105, 140, 175 and having a free end, an outer side, an inner side, and an outer wall length defined by a distance from the bottom surface of the annular cover to the free end of the outer wall.

An outer fin 205, 225, 245 extends radially from the inner side of the outer wall 107, 125, 240 adjacent to the free end of the outer wall. The outer fin 205, 225, 245 extends beneath and against the bottom of the outer edge of the paint can rim when the rim cover 105, 140, 175 is installed on a paint can. The outer fin 205, 225, 245 is cantilever (i.e., fixed at one end free at the opposite end), and extends towards an inner fin on the inner wall (described below). The length of the outer fin 205, 225, 245 is preferably less than the thickness (e.g., diameter or width) of the outer edge of the paint can rim, but sufficient to underlie at least a portion of such outer edge when installed. The fin 205, 225, 245 is flexible and resilient so that it may deflect past the outermost portion of such outer edge during installation.

An inner wall 108, 222, 242 forms an inner cylinder having an inner diameter. The inner wall 108, 222, 242 extends from the bottom surface of the annular cover 105, 140, 175 and has a free end an outer side, an inner side, and an inner wall length defined by a distance from the bottom surface of the annular cover to the free end of the inner wall.

An inner fin 210, 227, 250 extends radially from the outer side of the inner wall 108, 222, 242 adjacent to the free end of the inner wall. The inner fin 210, 227, 250 extends beneath and against the bottom of the inner edge of the paint can rim when the rim cover 105, 140, 175 is installed on a paint can. The inner fin 210, 227, 250 is cantilever (i.e., fixed at one end free at the opposite end), and extends towards an outer fin 205, 225, 245, which is generally opposite the inner fin 210, 227, 250. The length of the inner fin 210, 227, 250 is preferably less than the thickness (e.g., diameter or width) of the inner edge of the paint can rim, but sufficient to underlie at least a portion of such inner edge when installed. The fin 210, 227, 250 is flexible and resilient so that it may deflect past the outermost portion of such outer edge during installation.

A plug 215, 235, 255 forms an intermediate cylinder having an intermediate diameter. The plug 215, 235, 255 extends from the bottom surface of the annular cover 105, 140, 175 and has a free end, an outer side and an inner side. The plug length is defined by a distance from the bottom surface of the annular cover 105, 140, 175 to the free end of the plug. The plug width is defined by a distance from the outer side to the inner side. The plug length is preferably about equal to (but not substantially greater than) the depth of a groove of a corresponding paint can rim (i.e., a paint can rim to which the annular cover is configured to attach). The plug width is preferably about equal to the width of the of such a paint can rim. The diameter of the plug is preferably about the same as the diameter of the groove of such a paint can rim. The plug 215, 235, 255 is positioned between the inner cylinder defined by the inner wall 108, 222, 242 and the outer cylinder defined by the outer wall 107, 125, 240. Thus the plug is sized, shaped and configured to occupy space defined by the groove of a paint can rim when the annular rim cover is installed on a paint can. By occupying such space, the plug helps to prevent intrusion by spillage.

For each rim cover 105, 140, 175, the annular ring, inner cylinder, intermediate cylinder, and outer cylinder are concentric. For each rim cover 105, 140, 175, the inner diameter at the inner wall is less than the major diameter of the annular rim cover 105, 140, 175, and less than the outer diameter at the outer wall 107, 125, 240, and less than the intermediate diameter at the plug 215, 235, 255, and at least as great as the minor diameter of the annular rim cover 105, 140, 175. For each rim cover 105, 140, 175 the outer diameter is greater than the minor diameter of the annular rim cover 105, 140, 175, greater than the inner diameter at the inner wall 108, 222, 242, greater than the intermediate diameter at the plug 215, 235, 255, and not greater than the major diameter of the rim cover 105, 140, 175. The intermediate diameter at the plug 215, 235, 255 is between the inner diameter and the outer diameter, and about equal to the groove diameter of a corresponding paint can rim.

Figure 5:
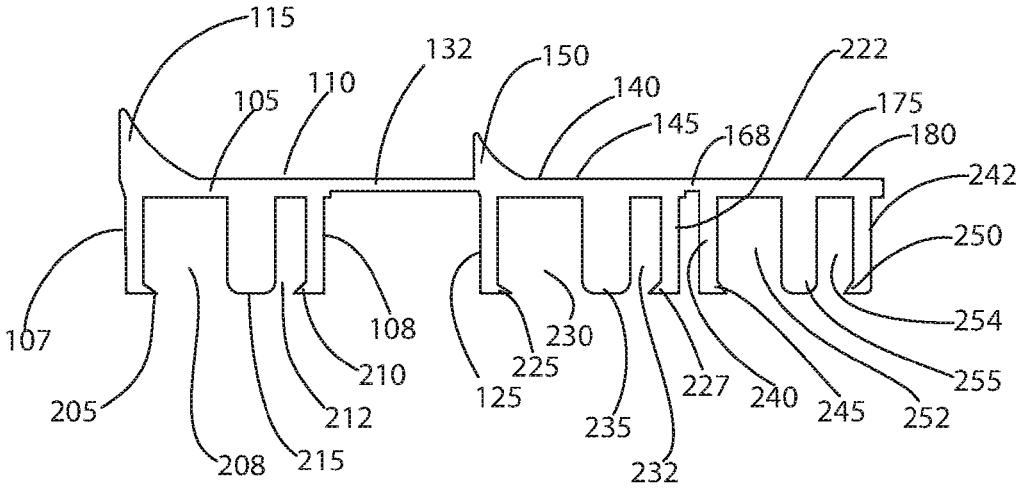
FIG. 5 is a cross section view (A-A from FIG. 1) of a portion of an exemplary paint can rim cover assembly comprising three separable paint can rim covers according to principles of the invention.

The inner wall, outer wall and plug of each annular cover define a pair of concentric annular spaces (channels), as shown in the cross section view (A-A from FIG. 1) of FIG. 5 and the bottom perspective view of FIG. 7. Each annular rim cover 105, 140, 175 includes an outer annular space (outer channel) 208, 230, 252 between the outer wall 107, 125, 240 and plug 215, 235, 255 for the respective rim cover 105, 140, 175. Similarly, each annular rim cover 105, 140, 175 includes an inner annular space (inner channel) 212, 232, 255 between the inner wall 108, 222, 242 and plug 215, 235, 255 for the respective rim cover 105, 140, 175. The inner channel receives a portion of the inner edge of a rim of a corresponding pant can, while the outer channel receives a portion of the outer edge of a rim of a corresponding pant can, when the annular cover is installed on the paint can. The outer channel is about at least twice as wide as the inner channel.

Figure 8:
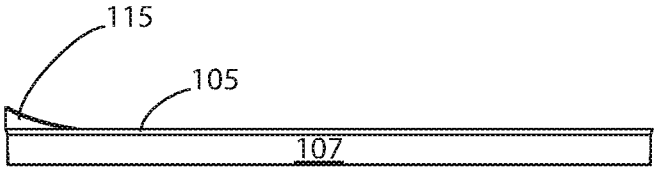
FIG. 8 is a side view of an exemplary paint can rim cover apart from a paint can according to principles of the invention.
Figure 8:
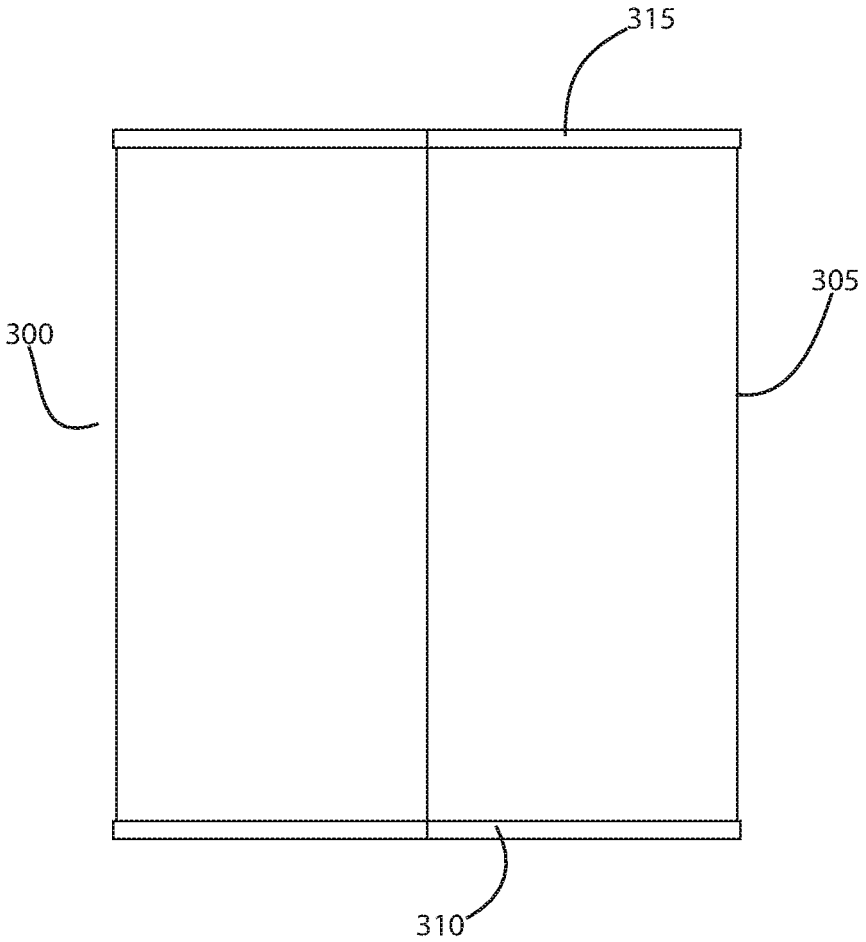
Figure 9:
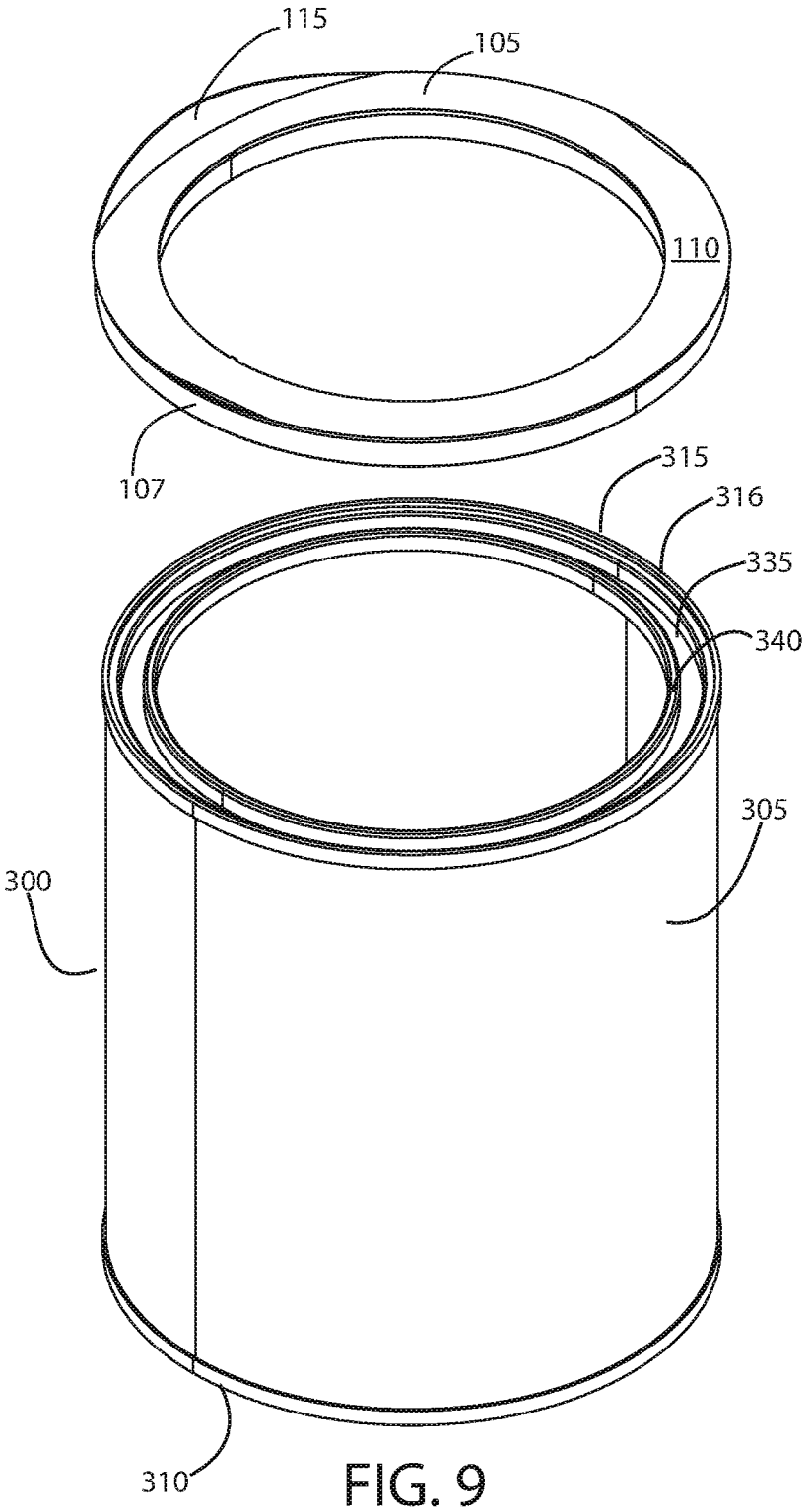
FIG. 9 is a top perspective view of an exemplary paint can rim cover apart from a paint can according to principles of the invention.
Figure 10:
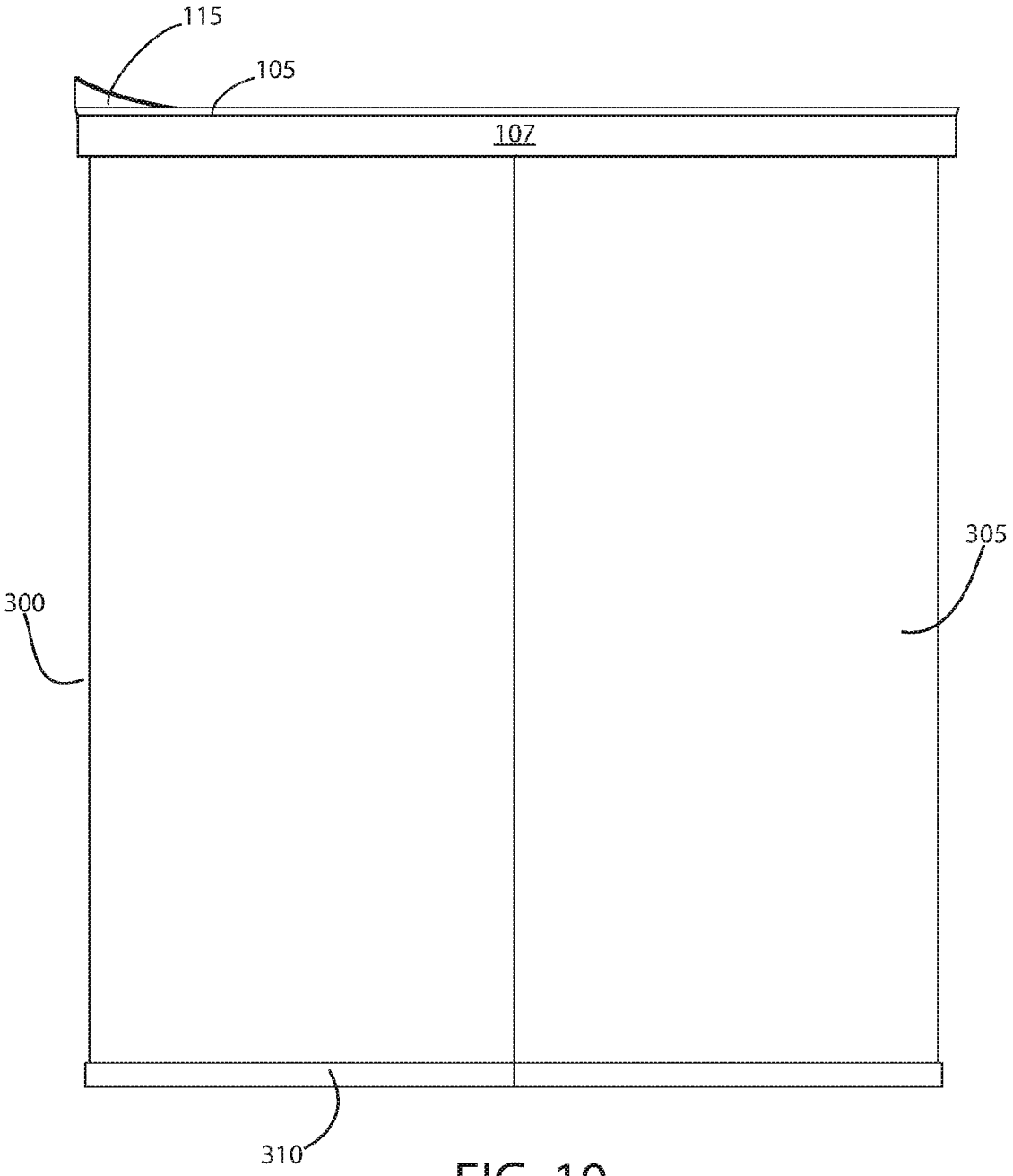
FIG. 10 is a side view of an exemplary paint can rim cover installed on a paint can according to principles of the invention.
Figure 11:
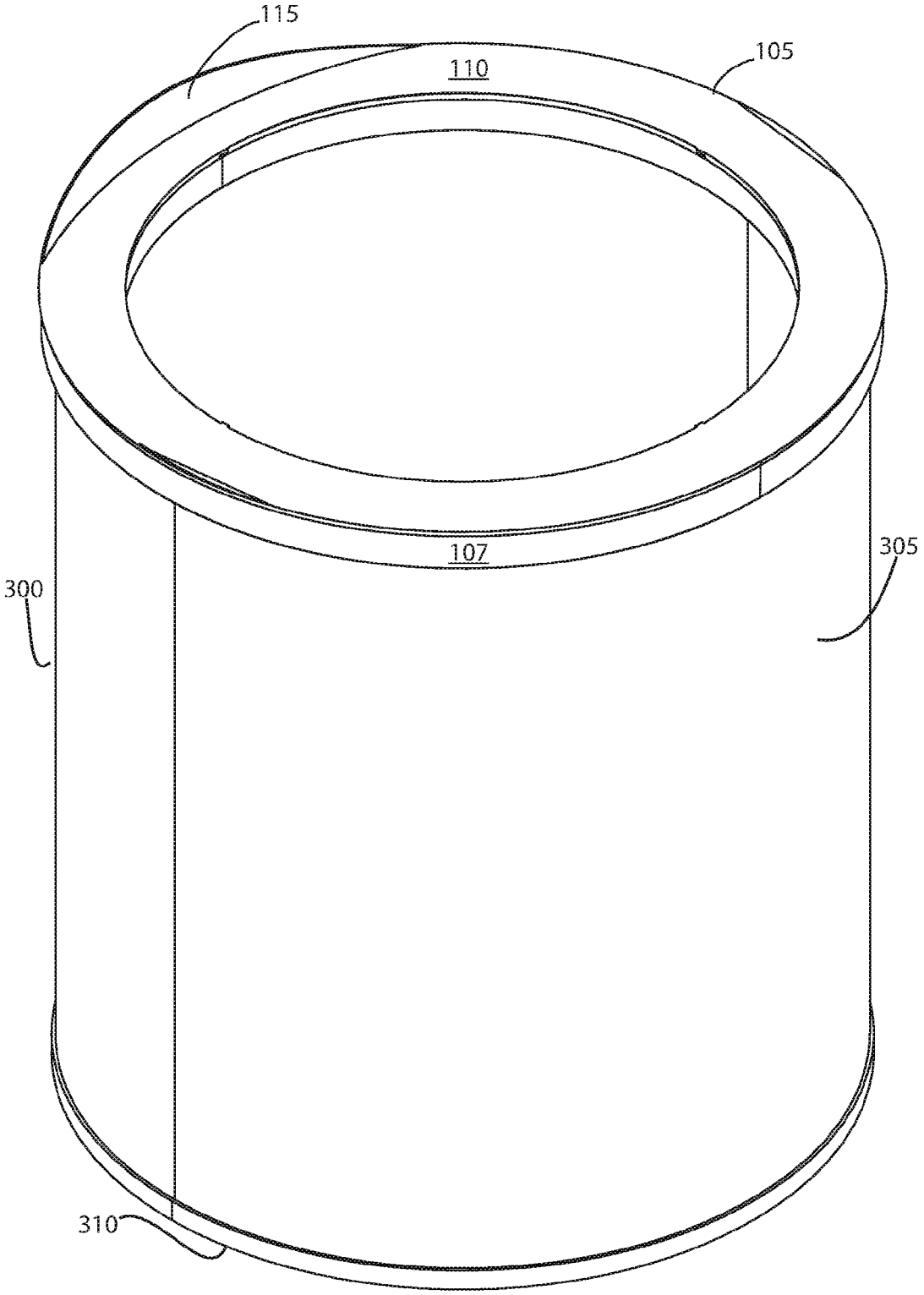
FIG. 11 is a top perspective view of an exemplary paint can rim cover installed on a paint can according to principles of the invention.

Referring now to FIGS. 8 through 11 various views of an exemplary paint can rim cover apart from and installed on a paint can according to principles of the invention are provided. In FIGS. 8 and 9 a rim cover 105 is shown above an open paint can 300, i.e., with a top lid removed. The paint can 300 includes a cylindrical body 305, bottom cover 310, and a top rim 315. The rim 315 includes an outer edge 316, a groove 317 and an inner edge 318. When the rim cover 105 is installed on the rim 315, the outer wall 107 of the rim cover 105 covers the outer edge 316 of the rim 315. The outer fin 205 extends under the outer edge 316 of the rim 315. The inner wall 108 covers the inner edge 340. The inner fin 210 extends under the inner edge 340 of the rim 315. The plug 215 substantially fills the groove 335.

Figure 12:
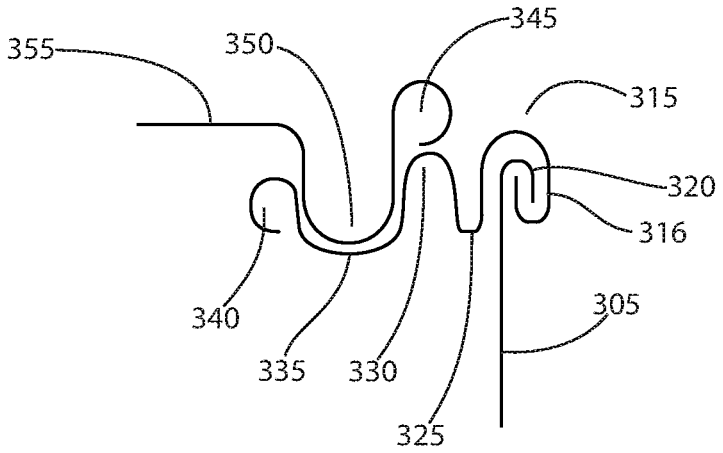
FIG. 12 schematically illustrates a paint can rim and an engaged lid according to principles of the invention.
Figure 13:
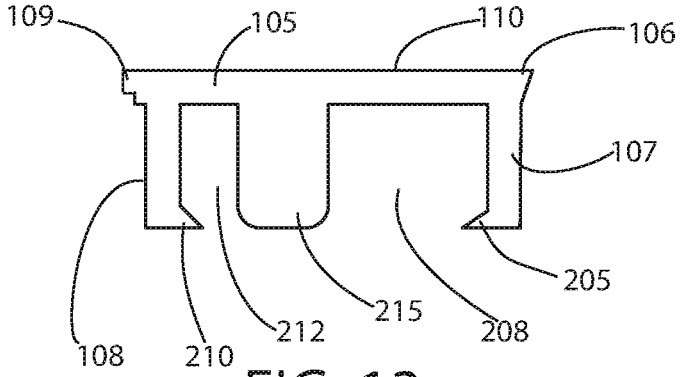
FIG. 13 schematically illustrates a cross section of a portion of an exemplary paint can rim cover according to principles of the invention.
Figure 14:
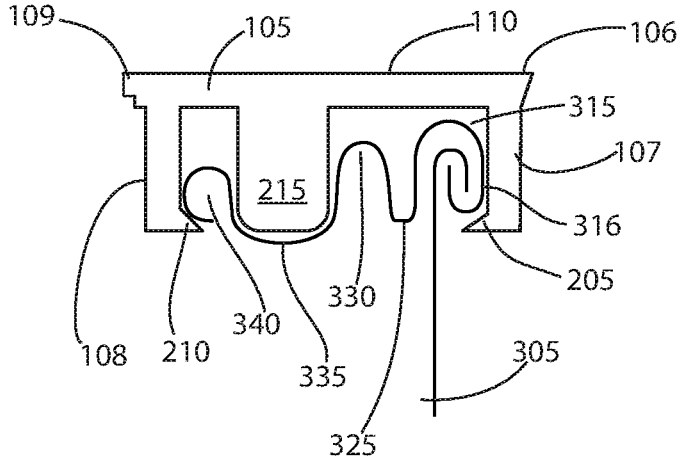
FIG. 14 schematically illustrates a cross section of a portion of an exemplary paint can rim cover installed on a paint can rim according to principles of the invention.

FIGS. 12 through 14 schematically illustrates cross sections of an exemplary paint can rim and an engaged lid and rim cover according to principles of the invention. In FIG. 12, the top flange 320 of the cylindrical body 305 of the can 300 is shown rolled or folded in the outer edge 316 of the rim 315. An outer annular groove 325 leads to an intermediate annular protuberance 330 providing corrugating reinforcement for structural integrity. The primary annular groove 335 is disposed between the edge 340 and the protuberance 330. The lid 335 includes a mating annular protuberance 350 and an edge 345. FIG. 13 schematically illustrates a cross section of a rim cover, including an outer wall 107 and fin 205, an inner wall 108 and fin 210, a plug 215 and outer and inner channels 208, 210. When installed on the rim, as conceptually illustrated in FIG. 14, the plug 215 substantially fills the primary groove 335, the inner channel 212 receives the inner edge 340, with the inner fin 210 extending below the inner edge 340, and the outer channel 208 receives the outer protuberance and edge 330, 316, with the outer fin 205 extending below the outer edge 316.

A rim cover according to principles of the invention may be comprised of any material that exhibits sufficient rigidity and strength, with flexibility and resiliency, to cover a rim of a paint can. By way of example and not limitation, the rim cover may be fabricated using plastic by any suitable plastic forming technique. For example, the rim cover may be comprised of a plastic or polymeric material, such as natural or synthetic rubber, polyvinyl chloride (PVC), nylon, polysulfone, polyethylene, polypropylene, polystyrene, acrylics, cellulosics, acrylonitrile-butadiene-styrene (ABS) terpolymers, urethanes, thermo-plastic resins, thermo-plastic elastomers (TPE), acetal resins, polyamides, polycarbonates and/or polyesters. Plasticizers or dispersants may be incorporated in the plastic to improve flexibility of the material. Other suitable polymeric compositions are known to those familiar with the art and may also be used in accordance with the present invention. Preferably the chosen material is relatively inexpensive, produces a durable and strong product, is easy to use in manufacturing operations and results in an aesthetically acceptable product.

The material may optionally further include additives to provide desired properties such as desired colors, structural characteristics, glow-in-the dark properties and thermal reactivity (e.g., color changes according to heat). Illustratively, phosphorescent polymer additives, such as aluminate based phosphors, may be added to adsorb light energy and continue to release that energy as visible light, after the energy source is removed. Advantageously, such an embodiment provides a glow-in-the-dark holder that is easy to locate in a dark space.

The holder 100 may be produced using any suitable manufacturing techniques known in the art for the chosen material, such as (for example) injection, compression, structural foam, blow, or transfer molding; polyurethane foam processing techniques; vacuum forming; casting; milling; and extrusion. Preferably the manufacturing technique is suitable for mass production at relatively low cost per unit, and results in an aesthetically acceptable product with a consistent acceptable quality and structural characteristics. An inner ledge 106 for wiping is provided. An outer beveled edge 106 (e.g., ledge) provides an overhang to reduce risk of dripping.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A rim cover assembly comprising an outer rim cover for a first size can, and an inner rim cover for a second size can smaller than the first size can, the outer rim cover and the inner rim cover being concentric, and the outer rim cover being coupled to the inner rim cover by a plurality of severable couplings, each of the inner rim cover and the outer rim cover comprising:

an annular cover with a top surface, a bottom surface opposite the top surface, an outer periphery, an inner periphery, a major diameter at the outer periphery, a minor diameter at the inner periphery, and an annular cover thickness measured from the top surface of the annular cover to the bottom surface of the annular cover;

an outer wall forming an outer cylinder having an outer diameter and extending from the bottom surface of the annular cover and having a free end, an outer side, an inner side, an outer wall length defined by a distance from the bottom surface of the annular cover to the free end of the outer wall, and an outer fin extending radially from the inner side of the outer wall adjacent to the free end of the outer wall;

an inner wall forming an inner cylinder having an inner diameter and extending from the bottom surface of the annular cover and having a free end an outer side, an inner side, an inner wall length defined by a distance from the bottom surface of the annular cover to the free end of the inner wall, and an inner fin extending radially from the outer side of the inner wall adjacent to the free end of the inner wall, opposite to and towards the outer fin;

a plug forming an intermediate cylinder having an intermediate diameter and extending from the bottom surface of the annular cover and having a free end, an outer side and an inner side, a plug length defined by a distance from the bottom surface of the annular cover to the free end of the plug, a plug width defined by a distance from the outer side to the inner side, the plug being between the inner cylinder and the outer cylinder;

the inner diameter being less than the rim inner diameter, less than the major diameter, less than the outer diameter, less than the intermediate diameter, and at least as great as the minor diameter;

the outer diameter being greater than the minor diameter, greater than the inner diameter, greater than the intermediate diameter, greater than the rim outer diameter, and not greater than the major diameter;

the intermediate diameter being between the inner diameter and the outer diameter, and about equal to the groove diameter; and the annular ring, inner cylinder, intermediate cylinder, and outer cylinder being concentric;

the plug length, inner wall length and outer wall length being about equal, and the plug length being about equal to the groove depth and the plug width being about equal to the groove width.

2. The rim cover assembly according to claim 1, each of the inner rim cover and the outer rim cover further comprising an inner wiping ledge extending from the inner periphery of the annular cover at the top surface of the annular cover, the inner wiping ledge comprising an inner cantilever projection having an inner ledge thickness that is less than the annular cover thickness.

3. The rim cover assembly according to claim 1, each of the inner rim cover and the outer rim cover further comprising an outer ledge extending from the outer periphery of the annular cover at the top surface of the annular cover, the outer ledge comprising an outer cantilever projection having an outer ledge thickness that is less than the annular cover thickness.

4. The rim cover assembly according to claim 1, the inner fin of each of the inner rim cover and the outer rim cover having a generally triangular cross-section shape.

5. The rim cover assembly according to claim 1, the outer fin of each of the inner rim cover and the outer rim cover having a generally triangular cross-section shape.

6. The rim cover assembly according to claim 1, each of the inner rim cover and the outer rim cover further comprising an inner cavity between the inner wall and the plug with an inner cavity width measured from the outer side of the inner wall to the plug; and an outer cavity between the outer wall and the plug with an outer cavity width measured from the inner side of the outer wall to the plug.

7. The rim cover assembly according to claim 1, the inner fin of each of the inner rim cover and the outer rim cover extending from the outer side of the inner wall up to one half of the width of the inner cavity.

8. The rim cover assembly according to claim 1, the outer fin of each of the inner rim cover and the outer rim cover extending from the inner side of the outer wall less than one half of the width of the outer cavity.

9. The rim cover assembly according to claim 1, the free end of the plug, of each of the inner rim cover and the outer rim cover, at the inner side, being filleted, and the free end of the plug at the outer side being filleted.

* * * * *